US005294104A

United States Patent [19]

Nishigaki

[11] Patent Number: 5,294,104

[45] Date of Patent: Mar. 15, 1994

[54] PAPER FEEDING DEVICE HAVING AN ADJUSTABLE PAPER FEED ROLLER FOR DIFFERENT SIZED SHEETS

[75] Inventor: Hideo Nishigaki, Nagoya, Japan

[73] Assignee: Brother Kogyo Kabushiki Kaisha, Nagoya, Japan

[21] Appl. No.: 978,382

[22] Filed: Nov. 18, 1992

[30] Foreign Application Priority Data

Jan. 31, 1992 [JP] Japan ..... 4-45934

[51] Int. Cl.[5] ..... B65H 3/06

[52] U.S. Cl. ..... 271/117; 271/164

[58] Field of Search ..... 271/117, 162, 164, 171

[56] References Cited

U.S. PATENT DOCUMENTS 4,098,501 7/1978 Tani et al. ..... 271/117
5,060,927 10/1991 Sugiura ..... 271/117
5,106,072 4/1992 Sugiura et al. .
5,139,252 8/1992 Morita et al. ..... 271/117

FOREIGN PATENT DOCUMENTS 607788 10/1978 Japan .
26619 2/1991 Japan ..... 271/117
2225776 6/1990 United Kingdom .

*Primary Examiner*—D. Glenn Dayoan
*Assistant Examiner*—Boris Milef
*Attorney, Agent, or Firm*—Oliff & Berridge

[57] ABSTRACT

A paper feeding device for feeding a sheet of paper from a paper feed cassette removably mounted in a body of an equipment includes a paper feed roller, a roller moving member for moving the paper feed roller between a normal position and a specific position, a fixing member for fixing the roller moving member so as to hold the specific position of the paper feed roller upon unloading the paper feed cassette, and a canceling member for canceling the fixation of the roller moving member by the fixing member so as to yet hold the specific position of the paper feed roller upon loading the paper feed cassette again. Accordingly, in the case of continuing to use the paper of the same size, it is possible to eliminate undue reciprocation of the paper feed roller between the normal position and the specific position upon loading and unloading the paper feed cassette and therefore reduce wear.

17 Claims, 5 Drawing Sheets

PAPER FEEDING DEVICE HAVING AN ADJUSTABLE PAPER FEED ROLLER FOR DIFFERENT SIZED SHEETS

BACKGROUND OF THE INVENTION

1. Field of the Invention

The present invention relates to a paper feeding device for feeding a sheet of paper from a paper feed cassette removably mounted in a body of equipment such as a copying machine or a printer.

2. Description of Related Art

In such a paper feeding device known in the prior art, a plurality of sheets of paper having different sizes, such as A4 size and B4 size, are stored in different paper feed cassettes corresponding to the different sizes, and the sheets of paper are fed one by one from a desired one of the paper feed cassettes into the body of the equipment. In the case where each paper feed cassette has a pair of sheet holding lugs located at the front corner portions of the cassette, it is common practice to locate a paper feed roller at a position where an outside end of the paper feed roller is spaced about 20 mm from a side edge of the sheets of paper. Accordingly, the position of the paper feed roller for feeding the paper having the A4 size is different from that for feeding the paper having the B4 size. In the case where the body of the equipment has a single cassette loading portion, i.e., a single paper feed opening, it is necessary to change the position of the paper feed roller according to the chosen paper size. There are various techniques in the prior art for changing the position of the paper feed roller according to a paper size.

For example, in a paper feeding device disclosed in U.S. Pat. No. 5,106,072, which is a division of Ser. No. 07/404,904 filed on Sep. 8, 1989 corresponding to United Kingdom Unexamined Patent Publication No. GB 2,225,776 A, and Japanese Patent Publication No. 60-7788, the paper feed roller is automatically moved to a proper position corresponding to a paper size and simultaneously set in this proper position when a paper feed cassette corresponding to this paper size is loaded into the body of the equipment Further, when the paper feed cassette corresponding to a specific paper size is unloaded from the body of the equipment, the paper feed roller is returned to its normal position corresponding to another paper size.

Another example of a prior art paper feeding device will now be described with reference to FIGS. 4 and 5. FIG. 4 is a plan view of an essential part of a prior art paper feeding device 42, and FIG. 5 is a side view of FIG. 4. Referring to FIGS. 4 and 5, the paper feeding device 42 is of a type such that a plurality of sheets of paper 32 stored in a paper feed cassette 31 are offset to the left side (as viewed in FIG. 4) of the paper feed cassette 31. A driving shaft 33 is rotatably supported at its opposite ends from the body of a printer. The driving shaft 33 is adapted to be driven to rotate so as to feed the paper 32 in a direction of arrow 400 shown in FIG. 4. A left feed roller 34*a* is fixedly mounted on the driving shaft 33, and a right feed roller 34*b* is axially slidably mounted on the driving shaft 33. The right feed roller 34*b* is provided with a known one-way clutch 35 so that the rotation of the driving shaft 33 in the paper feeding direction is transmitted to the right feed roller 34*b*, thereby obtaining integral rotation of the driving shaft 33 and the right feed roller 34*b*, while the rotation of the driving shaft 33 in the reverse direction is not transmitted to the right feed roller 34*b*, thereby obtaining idling of the driving shaft 33. That is, the right feed roller 34*b* is rotatable together with the driving shaft 33 through the clutch 35 in the paper feeding direction, and is axially slidable on the driving shaft 33 in the opposite direction. A compression spring 36 is interposed between the left feed roller 34*a* and the right feed roller 34*b* , so that the right feed roller 34*b* is normally biased to the right (as viewed in FIG. 4) by the compression spring 36. In FIG. 4, the paper 32 of A4 size is denoted by a one-dot chain line, and a portion of the paper 32 of B4 size exceeding the A4 size paper 32 is denoted by a two-dot chain line.

A roller moving lever 37 is pivotally supported on a shaft 38 mounted on the body of the printer. A tension spring 39 is provided between the roller moving lever 37 and the body of the printer to normally bias the roller moving lever 37 to its normal position shown by a dashed line in FIG. 4. The right feed roller 34*b* is normally biased to its normal position shown by a dashed line in FIG. 4, by the compression spring 36 so as to deflect the roller moving lever 37. Thus, the roller moving lever 37 and the right feed roller 34*b* are normally held in the respective normal positions by the tension spring 39 and the compression spring 36, respectively.

Further, in the case where the paper feed cassette 31 is an A4 paper cassette for storing the sheets of paper 32 having the A4 size, the A4 paper cassette is provided with a roller moving chip 40 for moving the roller moving lever 37 from the normal position to a specific position shown by a solid line in FIG. 4. That is, when the A4 paper cassette is loaded into the body of the printer, the roller moving chip 40 is brought into engagement with a projection 41 of the roller moving lever 37 to urge the projection 41 to the specific position. In the case where the paper feed cassette 31 is a B4 paper cassette for storing the sheets of paper 32 having the B4 size, the B4 paper cassette is not provided with the roller moving chip 40.

The operation of the paper feeding device 42 mentioned above will now be described. When the B4 paper cassette is loaded into the body of the printer, the roller moving lever 37 is maintained in its normal position shown by the dashed line in FIG. 4 because the roller moving chip 40 is not included in the B-4 paper cassette. Accordingly, the right feed roller 34*b* is also held in its normal position shown by the dashed line in FIG. 4 by the roller moving lever 37.

In contrast, when the A4 paper cassette is loaded into the body of the printer, the roller moving lever 37 is urged by the roller moving chip 40 of the A4 paper cassette to move from the normal position shown by (he dashed line in FIG. 4 to the specific position shown by the solid line in FIG. 4. Accordingly, the right feed roller 34*b* is urged by the roller moving lever 37 to move from the normal position shown by the dashed line in FIG. 4 to the specific position shown by the solid line in FIG. 4.

When the A4 paper cassette is unloaded from the body of the printer, the roller moving lever 37 is returned to its normal position by the tension spring 39. Accordingly, the right feed roller 34*b* is also returned to its normal position by the compression spring 36.

However, in such a paper feeding device, paper having the specific size (e.g., A4 size in the above case) is mostly used, but the paper feed roller is reciprocated between the normal position and the specific position whenever the paper feed cassette corresponding to the specific size is loaded into and unloaded from the body of the equipment in supplying fresh sheets of paper into the paper feed cassette. Such undue reciprocation of the paper feed roller causes wearing at a sliding portion between the paper feed roller and the driving shaft or a pivotal portion between the roller moving lever and the shaft. Accordingly, there is the possibility of malfunction such that the paper feed roller cannot be returned to its normal position because of the worn sliding portion.

SUMMARY OF THE INVENTION

It is accordingly an object of the present invention to provide a highly reliable paper feeding device which can move and set the paper feed roller to a proper position corresponding to a paper size by a simple operation of loading the paper feed cassette corresponding to the paper size.

It is another object of the present invention to provide a highly reliable paper feeding device which can eliminate undue reciprocation of the paper feed roller between the normal position and the specific position upon loading and unloading the paper feed cassette in the case of continual use of the same-sized paper.

According to the present invention, a paper feeding device is provided for feeding a sheet of paper from a paper feed cassette removably mounted in a body of an equipment. The paper feed cassette comprises a first paper feed cassette for storing a plurality of sheets of paper having a specific size and a second paper feed cassette for storing a plurality of sheets of paper having any size other than the specific size. The first and second paper feed cassettes are replaceably loaded into the body of the equipment. The improved paper feeding 15 assembly comprises a driving shaft rotatably supported at opposite ends thereof to the body of the equipment; a paper feed roller axially movably mounted on the driving shaft; first biasing means for normally biasing the paper feed roller to a normal position thereof; roller holding means provided in the body of the equipment, for normally holding the paper feed roller at the normal position; second biasing means for normally biasing the roller holding means to a normal position thereof; roller moving means provided in the first paper feed cassette, for moving the paper feed roller from the normal position to a specific position against a biasing force of the first biasing means upon loading the first paper feed cassette into the body of the equipment so as to engage the roller holding means and urge the roller holding means against a biasing force of the second biasing means; fixing means provided in the body of the equipment, for fixing the roller holding means against the biasing force of the second biasing means to thereby hold the paper feed roller in its normal position upon unloading the first paper feed cassette from the body of the equipment; and canceling means provided in both the first and second paper feed cassettes, for canceling fixation of the roller holding means by the fixing means upon loading one of the first and second paper feed cassettes into the body of the equipment.

In operation, when the first paper feed cassette storing the sheets of paper having the specific size is loaded into the body of the equipment, the roller holding means provided in the body of the equipment is urged by the roller moving means provided in the first paper feed cassette. At the same time, the paper feed roller held in the normal position is moved to the specific position by the roller holding means. Thereafter, when the first paper feed cassette is unloaded from the body of the equipment, the roller holding means is fixed against the biasing force of the second biasing means by the fixing means provided in the body of the equipment. Accordingly, 15 the paper feed roller is held in substantially the same position, that is, in the specific position by he roller holding means. Thereafter, when the first paper feed cassette is loaded into the body of the equipment, the fixation of the roller holding means by the fixing means is canceled by the canceling means provided in the first paper feed cassette. However, as the roller holding means is urged by the roller moving means of the first paper feed cassette, the paper feed roller is held in the specific position by the roller holding means. In contrast, when the second paper feed cassette storing the sheets of paper having a size different from the specific size is loaded into the body of the equipment, the fixation of the roller holding means by the fixing means is canceled by the canceling means provided in the second paper feed cassette. In this case, as the second paper feed cassette does not have the roller moving means, the roller holding means is returned to its normal position by the biasing force of the second biasing means. At the same time, the paper feed roller is returned to its normal position by the biasing force of the first biasing means.

As described above, the paper feed roller can be moved to a proper position corresponding to a paper size by a simple operation of loading the paper feed cassette corresponding to the paper size. Further, the paper feeding device includes the fixing means for fixing the roller holding means holding the paper feed roller in the specific position and also includes the canceling means for canceling the fixation of the roller holding means by the fixing means. Accordingly, in the case of continuing to use the paper having the specific size, it is possible to eliminate undue reciprocation of the paper feed roller between the normal position and the specific position upon loading and unloading the paper feed cassette storing the paper of the specific size, thereby greatly reducing the wearing to be caused by the undue reciprocation. Therefore, it is possible to prevent a malfunction causing the paper feed roller to not be properly returned to the normal position because of such wearing. Thus, a high reliability of the paper feeding device can be ensured.

Other objects and features of the invention will be more fully understood from the following detailed description and appended claims when taken with the accompanying drawings.

DESCRIPTION OF PREFERRED EMBODIMENTS

A preferred embodiment of the present invention will now be described with reference to the drawings.

Figure 1:
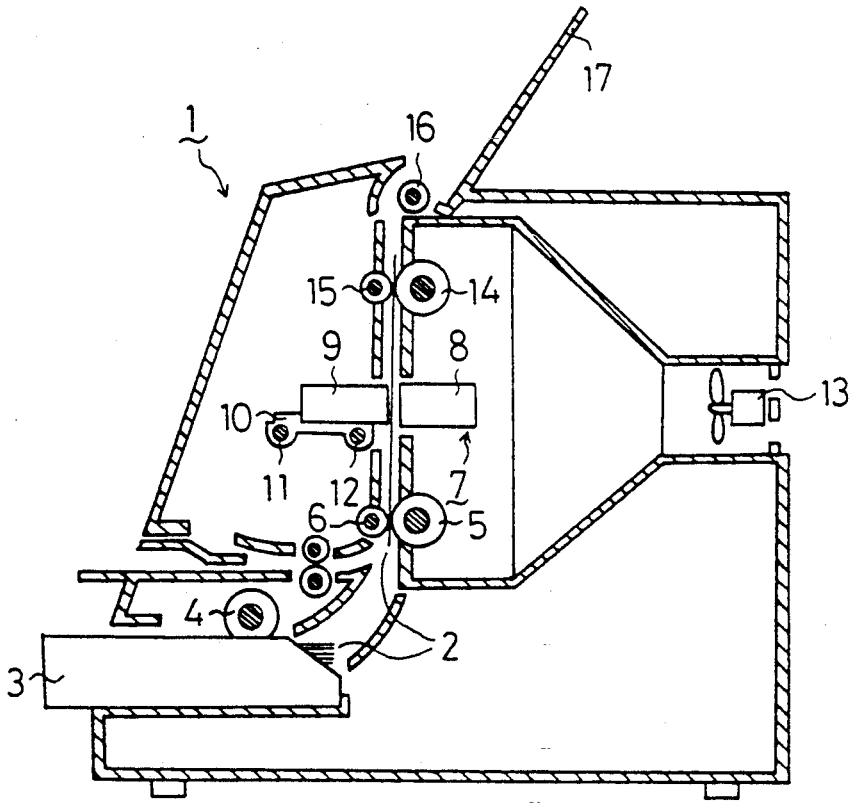
FIG. 1 is a sectional side view of an ink jet printer in a preferred embodiment according to the present invention.

FIG. 1 shows a general construction of an ink jet printer 1 in the preferred embodiment according to the present invention. Referring to FIG. 1, a paper feed cassette 3 storing a plurality of sheets of paper 2 is removably provided in the ink jet printer 1. The sheets of paper 2 are fed one by one by a paper feed roller 4 from the paper feed cassette 3 to between a lower feed roller 5 and a nip roller 6. Then, the sheet of paper 2 is fed by the lower feed roller 5 and the nip roller 6 to a printing section 7. The printing section 7 includes a platen 8 and a printing head 9 disposed opposite to the platen 8.

The printing head 9 is mounted on a carriage 10. The carriage 10 is movably supported on two guide shafts 11 and 12. The carriage 10 is adapted to be moved on the two guide shafts 11 and 12 in a direction perpendicular to a paper feeding direction by driving a carriage motor (not shown). The paper 2 fed to the printing section 7 is brought into close contact with the platen 8 by a vacuum 15 generated by a suction fan 13. Ink is ejected from the printing head 9 to the paper 2 on the platen 8, thereby performing a printing operation. After the printing operation in the printing section 7, the paper 2 is fed by an upper feed roller 14 and a nip roller 15, and is ejected by a paper ejecting roller 16 to a paper ejecting tray 17.

Figure 2:
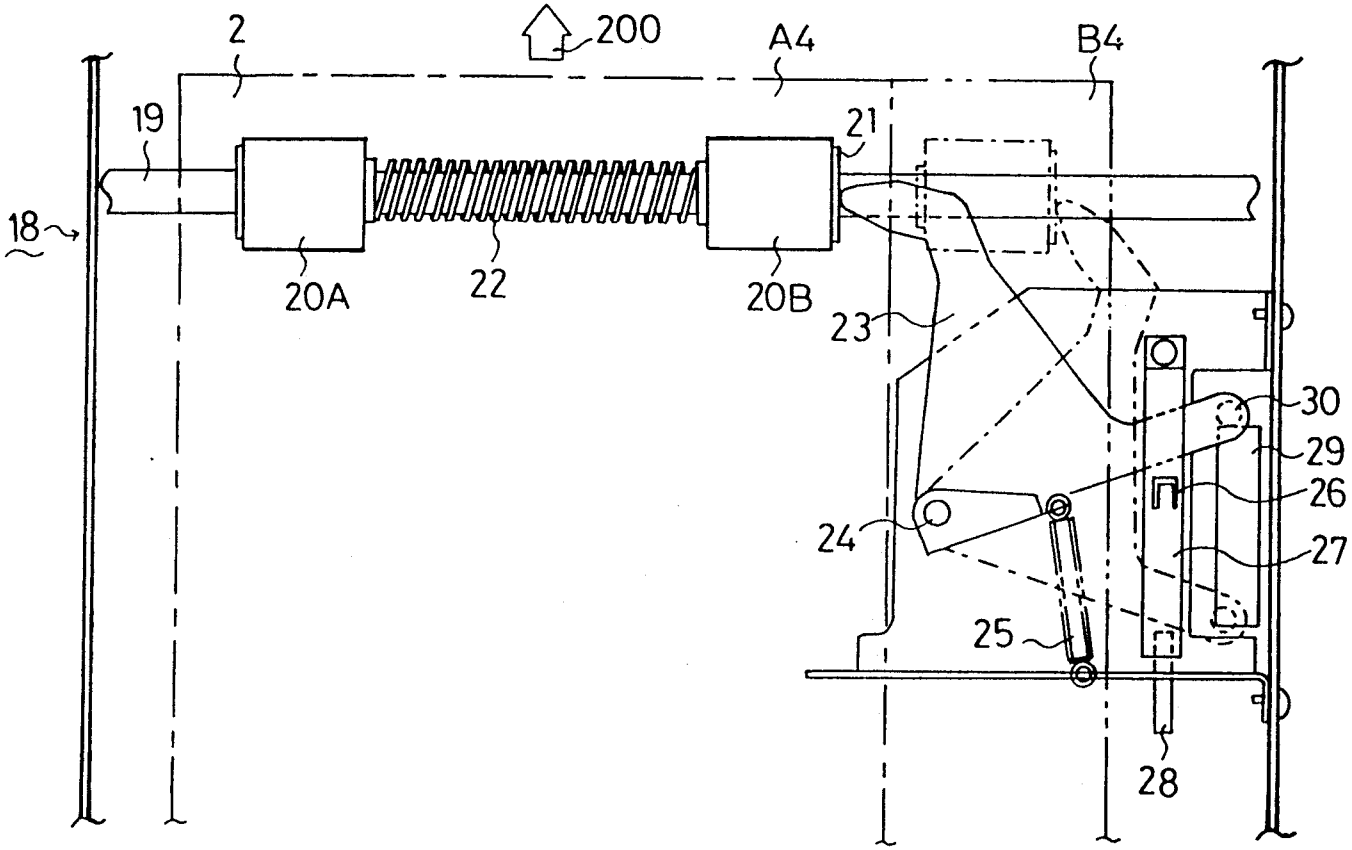
FIG. 2 is a plan view of an essential part of a paper feeding device in the preferred embodiment.
Figure 3:
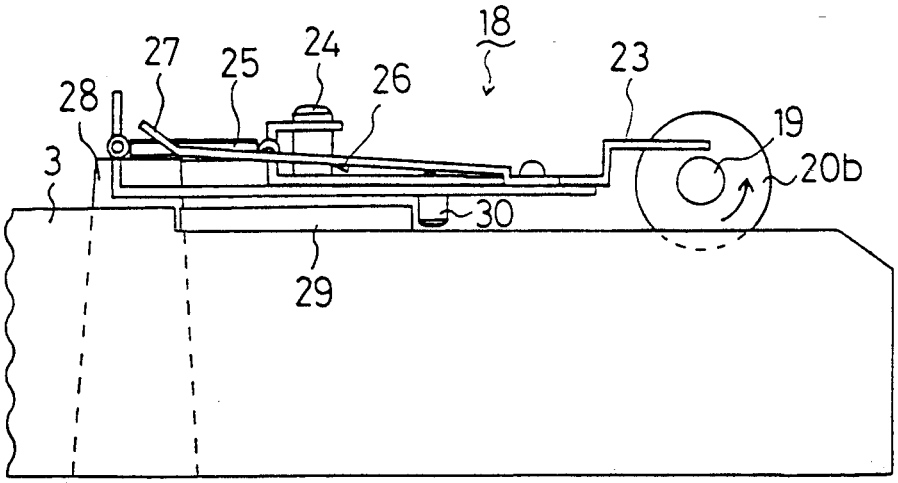
FIG. 3 is a side view of FIG. 2.
Figure 4:
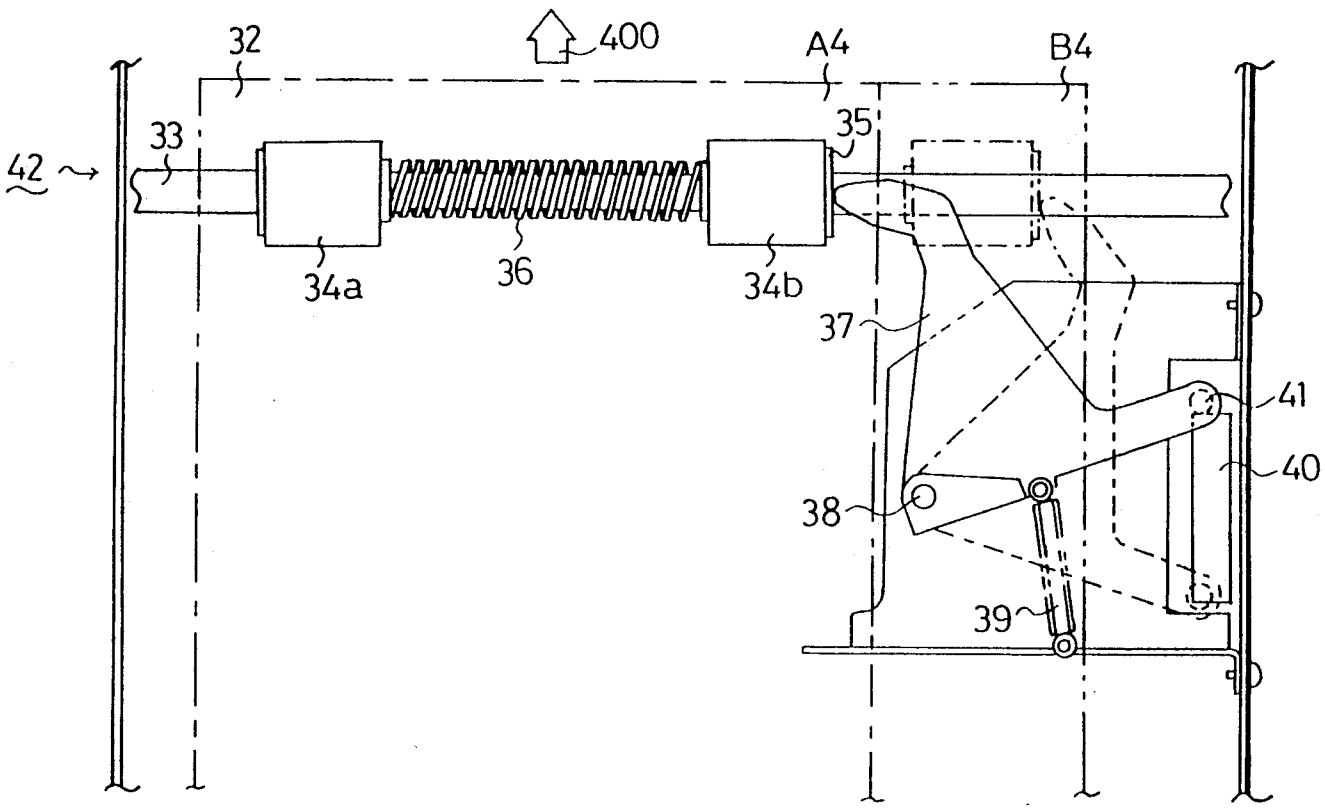
Fig.4 RELATED ART
FIG. 4 is a plan view of a paper feeding device in the prior art.
Figure 5:
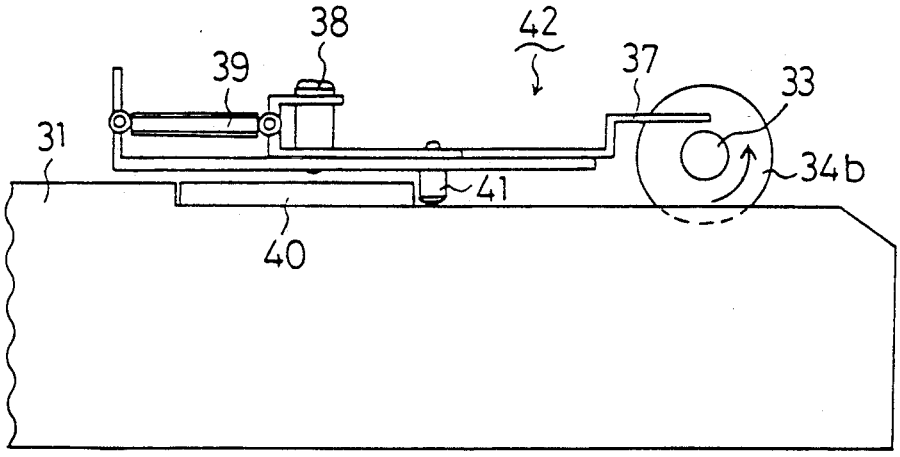
Fig.5 RELATED ART
FIG. 5 is a side view of FIG. 4.

FIG. 2 is a plan view of an essential part of a paper feeding device 18 in the preferred embodiment, and FIG. 3 is a side view of FIG. 2. Referring to FIGS. 2 and 3, the paper feeding device 18 is of a type such that the sheets of paper 2 stored in the paper feed cassette 3 are offset to a left side (as viewed in FIG. 2) of the paper feed cassette 3. A driving shaft 19 is rotatably supported at its opposite ends to the body of the printer 1. The driving shaft 19 is adapted to be driven to rotate so as to feed the paper 2 in a direction of arrow 200 shown in FIG. 2. A left feed roller 20A is fixedly mounted on the driving shaft 19, and a right feed roller 20B is axially slidably mounted on the driving shaft 19. The right feed roller 20B is provided with a known one-way clutch 21 so that the rotation of the driving shaft 19 in the paper feeding direction is transmitted to the right feed roller 20B, thereby obtaining integral rotation of the driving shaft 19 and the right feed roller 20B, while the rotation of the driving shaft 19 in the reverse direction is not transmitted to the right feed roller 20B, thereby obtaining idling of the driving shaft 19. That is, the right feed roller 20B is rotatable together with the driving shaft 19 through the clutch 21 in the paper feeding direction, and is axially slidable on the driving shaft 19 in the opposite direction. A compression spring 22 as the first biasing means according to the present invention is interposed between the left feed roller 20A and the right feed roller 20B, so that the right feed roller 20B is normally biased to the right (as viewed in FIG. 2) by the compression spring 22. In FIG. 2, the paper 2 of an A4 size is denoted by a one-dot chain line, and a portion of the paper 2 of a B4 size exceeding the A4 size paper 2 is denoted by a two-dot chain line.

A roller moving lever 23 as the roller holding means according to the present invention is pivotally supported to a shaft 24 mounted on the body of the printer 1. A tension spring 25 as the second biasing means according to the present invention is provided between the roller moving lever 23 and the body of the printer 1 to normally bias the roller moving lever 23 to its normal position shown by a dashed line in FIG. 2. The right feed roller 20B is normally biased to its normal position, shown by a dashed line in FIG. 2, by the compression spring 22 so as to urge the roller moving lever 23. Thus, the roller moving lever 23 and the right feed roller 20B are normally held in the respective normal positions by the tension spring 25 and the compression spring 22, respectively.

A leaf spring 27 is mounted at one end thereof to the body of the printer 1 so as to resiliently overlap the roller moving lever 23. The leaf spring 27 is provided with a downwardly projecting pawl 26 as the fixing means according to the present invention. The pawl 26 is adapted to engage the roller moving lever 23. That is, when the roller moving lever 23 is moved to its specific position shown by a solid line in FIG. 2, and is thereafter to be returned to the normal position by the tension spring 25, the pawl 26 comes into engagement with the roller moving lever 23 to stop the return movement of the roller moving lever 23 to the normal position.

The paper feed cassette 3 is provided with a canceling member 28 as the canceling means according to the present invention, for canceling the engagement of the pawl 26 of the leaf spring 27 with the roller moving lever 23. That is, when the paper feed cassette 3 is loaded into the body of the printer 1 in the condition where the pawl 26 is in engagement with the roller moving lever 23, the leaf spring 27 is forcibly lifted by the canceling member 28 to thereby disengage the pawl 26 from the roller moving lever 23 as shown in FIG. 3.

Further, in the case where the paper feed cassette 3 is an A4 paper cassette for storing the sheets of paper 2 having the A4 size, the A4 paper cassette is provided with a roller moving chip 29 as the roller moving means according to the present invention, for moving the roller moving lever 23 from the normal position to the specific position. That is, when the A4 paper cassette is loaded into the body of the printer 1, the roller moving chip 29 is brought into engagement with a projection 30 of the roller moving lever 23 to urge the projection 30 to the specific position. In the case where the paper feed cassette 3 is a B4 paper cassette for storing the sheets of paper 2 having the B4 size, the B4 paper cassette is not provided with the roller moving chip 29. Further, both the A4 paper cassette and the B4 paper cassette have the canceling member 28.

The operation of the paper feeding device 18 mentioned above will now be described. When the B4 paper cassette is loaded into the body Of he printer 1, the roller moving lever 23 is maintained in its normal position shown by the dashed line in FIG. 2 because the roller moving chip 29 is not included in the B4 paper cassette. Accordingly, the right feed roller 20B is also held in its normal position shown by the dashed line in FIG. 2 by the roller moving lever 23.

In contrast, when the A4 paper cassette is loaded into the body of the printer 1, the roller moving lever 23 is urged by the roller moving chip 29 of the A4 paper cassette to move from the normal position shown by the dashed line in FIG. 2 to the specific position shown by the solid line in FIG. 2. Accordingly, the right feed roller 20B is urged by the roller moving lever 23 to move from the normal position shown by the dashed line in FIG. 2 to the specific position shown by the solid line in FIG. 2.

When the A4 paper cassette is unloaded from the body of the printer 1, the roller moving lever 23 is 15 inclined to be returned to its normal position by the tension spring 25. However, the pawl 26 of the leaf spring 27 comes into engagement with the roller moving lever 23 to stop the return movement of the roller moving lever 23. Accordingly, the right feed roller 20B is held in substantially the same position, that is, in its specific position by the roller moving lever 23.

Thereafter, when the A4 paper cassette is loaded again into the body of the printer 1, the leaf spring 27 is lifted by the canceling member 28 of the A4 paper cassette to cancel the engagement of the pawl 26 of the leaf spring 27 with the roller moving lever 23. However, as the specific position of the roller moving lever 23 is held by the roller moving chip 29 of the A4 paper cassette, the right feed roller 20B hardly moves to hold its specific position.

In contrast, when the B4 paper cassette is loaded into the body of the printer 1 after unloading the A4 paper cassette, the leaf spring 27 is lifted by the canceling member 28 of the B4 paper cassette to cancel the engagement of the pawl 26 of the leaf spring 27 with the roller moving lever 23. In this case, since the B4 paper cassette does not have the roller moving chip 29, the roller moving lever 23 is returned to its normal position by the tension spring 25. Accordingly, at the same time, the right feed roller 20B is also returned to its normal position by the compression spring 22.

As described above, in the paper feeding device 18 in the above preferred embodiment, the right feed roller 20B can be moved to a proper position corresponding to a size of the paper 2 and set in this proper position by a simple operation of loading the paper feed cassette 3 corresponding to the size of the paper 2. Further, the paper feeding device 18 includes the leaf spring 27 having the pawl 26 for fixing the roller moving lever 23 and also includes the canceling member 28 for canceling the fixation of the roller moving lever 23 by the pawl 26 Accordingly, in the case of continuing to use the paper 2 having the A4 size, it is possible to eliminate undue reciprocation of the right feed roller 20B between the normal position and the specific position upon loading and unloading the A4 paper cassette, thereby greatly reducing the wearing at a sliding portion between the right feed roller 20B and the driving shaft 19 and at a pivotal portion between the roller moving lever 23 and the shaft 24. Therefore, it is possible to prevent a malfunction due to such wear wherein the right feed roller 20B cannot be properly returned to the normal position.

While the invention has been described with reference to a specific embodiment, the description is illustrative and is not to be construed as limiting the scope of the invention. Various modifications and changes may occur to those skilled in the art without departing from the spirit and scope of the invention as defined by the appended claims.

What is claimed is:

1. A paper feeding device for use with a removable paper feed cassette for feeding a sheet from the paper feed cassette to equipment, comprising:

a frame and a shaft supported by said frame;

a paper feed roller positionable in a first position and a second position on said shaft feeding first and second sized sheets respectively from the paper feed cassette;

a roller moving mechanism movable between a first and second position coupled to said frame moving said paper feed roller between said first position and said second position, said roller moving mechanism being in said first position when said paper feed roller is in said first position; and a first elastic biasing member carried on said shaft that normally biases said paper feed roller into said first position;

a second elastic biasing member coupled to said roller moving mechanism coupled to said frame to normally bias said roller moving mechanism into said first position; and a fixing mechanism coupled to said frame and fixing said roller moving mechanism in said second position upon removal of the paper feed cassette from the equipment.

2. The paper feeding device of claim 1, wherein said shaft comprises a rotatable drive shaft having ends adapted to be coupled to the equipment and said paper feed roller comprises a pair of rollers supported on said drive shaft, one of said rollers being fixed to said drive shaft and the other of said rollers being axially slidable on said drive shaft, and said first elastic biasing member comprises a compression spring biased between said fixed roller and said slidable roller to normally bias said other roller in said first position.

3. The paper feed device of claim 2, wherein said slidable roller is provided with a one-way clutch to transmit rotation to said slidable roller in a forward direction.

4. The paper feed device of claim 1, wherein said roller moving mechanism comprises a pivotal lever located adjacent to and in contact with said paper feed roller and adapted to be supported by the equipment, and said second elastic biasing member comprises a tension spring contacting said lever to bias said lever to position said paper feed roller in said first position.

5. The paper feed device of claim 1, wherein said fixing mechanism comprises a leaf spring adapted to be mounted to the equipment and contacting said roller moving mechanism and having an outwardly extending pawl to engage said roller moving mechanism in said second position.

6. The paper feed device of claim 1 in combination with the paper feed cassette, further comprising a canceling member for canceling fixing of said roller moving mechanism by said fixing mechanism.

7. The paper feed device of claim 6, wherein said canceling member comprises a projection on said cassette which engages with said fixing mechanism.

8. The paper feed device of claim 6, wherein said fixing mechanism comprises a leaf spring mounted to a body of a printer contacting said roller mechanism and having an outwardly extending pawl to engage said roller moving mechanism in said second position, and said canceling member disengages said pawl from said roller moving mechanism.

9. The paper feed device of claim 6, wherein said cassette includes a roller moving chip for engaging said roller moving mechanism to move said paper feed roller from said first position to said second position.

10. A paper feed assembly, comprising:

a frame body;

a paper feed device mounted in said body, including a driving shaft rotatably supported by said body, a paper feed roller means axially movably mounted on said driving shaft and movable between a first position and a second position, a first biasing means for normally biasing said paper feed roller means to said first position, a roller moving means provided in said body and movable between said first position and said second position for normally holding said paper feed roller means in said first position, a second biasing means for normally biasing said roller moving means to said first position, and a fixing means provided in said body for fixing said roller moving means against the biasing force of said second biasing means to hold said paper feed roller means in said second position; and a paper feed cassette means removably mounted in said body, the paper feed cassette means comprising a first paper feed cassette for storing a plurality of sheets of paper having a first size, a second paper feed cassette for storing a plurality of sheets of paper having a second size, said first and second paper feed cassettes being interchangeable in said body, a canceling member provided in both said first and second paper feed cassettes, wherein said canceling member cancels fixation of said roller moving means by said fixing means upon loading one of said first and second paper feed cassettes into said body, and a position moving means provided in said first paper feed cassette, for moving said paper feed roller means from said first position to said second position against a biasing force of said first biasing means upon loading said first paper feed cassette into said body to engage said roller moving means and urge said roller moving means against a biasing force of said second biasing means, wherein said fixing means holds said paper feed roller means in said first position upon unloading said first paper feed cassette from said body.

11. The assembly of claim 10, wherein said paper feed roller means comprises a pair of rollers supported on said drive shaft, one of said rollers being fixed to said drive shaft and the other of said rollers being axially slidable on said drive shaft.

12. The assembly of claim 11, wherein said first biasing means comprises a compression spring biased between said fixed roller and said slidable roller to normally bias said slidable roller in said first position.

13. The assembly of claim 10, wherein said roller moving means comprises a pivotal lever located adjacent to and in contact with said paper feed roller means and supported by said body, and said second biasing means comprises a tension spring biased between said lever and said body to bias said lever to position said paper feed roller means in said first position.

14. The assembly of claim 10, wherein said fixing means comprises a leaf spring mounted to said body and contacting said roller moving means and having an outwardly extending pawl to engage said roller moving means in said second position.

15. The assembly of claim 10, wherein said canceling member comprises a projection on said cassette which engages with said fixing means.

16. The assembly of claim 15, wherein said fixing means comprises a leaf spring mounted to said body contacting said roller moving means and having an outwardly extending pawl to engage said roller moving means in said second position, and said canceling member disengages said pawl from said roller moving means.

17. The assembly of claim 10, wherein said position moving means comprises a chip on said cassette which engages said roller moving means and pivots said roller moving means between said first position and said second position.

* * * * *